United States Patent [19]

Hayafune et al.

[11] Patent Number: 4,755,716

[45] Date of Patent: Jul. 5, 1988

[54] FILTER FOR CRT SCREEN

[75] Inventors: Koji Hayafune, Tokyo; Hideo Amemiya, Yokohama; Eiiti Sugihara, Zusi, all of Japan

[73] Assignee: Mitsui Toatsu Chemicals, Inc., Tokyo, Japan

[21] Appl. No.: 74,037

[22] Filed: Jul. 16, 1987

[30] Foreign Application Priority Data

| | | | |
|---|---|---|---|
| Jul. 21, 1986 | [JP] | Japan | 61-169678 |
| Aug. 4, 1986 | [JP] | Japan | 61-181856 |
| Aug. 4, 1986 | [JP] | Japan | 61-181858 |
| Sep. 3, 1986 | [JP] | Japan | 61-205896 |
| Nov. 11, 1986 | [JP] | Japan | 61-266530 |
| Nov. 11, 1986 | [JP] | Japan | 61-266531 |
| Dec. 24, 1986 | [JP] | Japan | 61-306208 |
| Jan. 12, 1987 | [JP] | Japan | 62-003352 |
| Jan. 12, 1987 | [JP] | Japan | 62-003353 |
| Mar. 16, 1987 | [JP] | Japan | 62-058756 |

[51] Int. Cl.[4] ..... H01J 29/89

[52] U.S. Cl. ..... 313/478; 313/479; 313/112

[58] Field of Search ..... 313/478, 479, 477 R, 313/112, 313; 315/85

[56] References Cited

U.S. PATENT DOCUMENTS

| | | | |
|---|---|---|---|
| 3,378,636 | 4/1968 | Hamilton | 313/112 X |
| 4,253,737 | 3/1981 | Thomsen et al. | 350/276 |
| 4,631,214 | 12/1986 | Hasegawa | 315/85 X |

FOREIGN PATENT DOCUMENTS

| | | | |
|---|---|---|---|
| 0149150 | 7/1985 | European Pat. Off. | 313/478 |
| 55-12107 | 1/1980 | Japan . | |
| 56-32653 | 4/1981 | Japan . | |
| 57-126054 | 8/1982 | Japan . | |
| 0094337 | 5/1984 | Japan | 313/479 |
| 59-106176 | 7/1984 | Japan . | |
| 60-107802 | 7/1985 | Japan . | |
| 60-125681 | 8/1985 | Japan . | |
| 61-015480 | 1/1986 | Japan . | |
| 61-046903 | 3/1986 | Japan . | |

*Primary Examiner*—Palmer C. DeMeo

*Attorney, Agent, or Firm*—Fisher, Christen & Sabol

[57] ABSTRACT

A filter for a CRT screen according to the invention is constituted such that a compound sheet consisting of a conductive net and a transparent resin film is molded so as to be closely attached to the CRT screen, and also to avoid the occurrence of moire fringes, the mesh of the net is selected at a suitable value such that the ratio of the pitch of the scanning lines of the CRT and the pitch of the wires of the net does not fall near simple integers or the inverse numbers thereof. The filter can shut off the electromagnetic waves, electrostatic charge, ultraviolet rays, etc. which are generated from the CRT, without spoiling the resolution of the CRT and can substantially prevent adverse influences on the human body by the CRT. No moire fringes are produced on the screen. A hard coating treatment and a glare-proofing treatment are further performed, so that an illumination lamps or the like in the room are not reflected from the filter surface. Therefore, the operators can continue their work without fatigue of the eyes and without adverse mental influence based on such fatigue. Further, when the surface of the CRT filter is cleaned or even if a point of pencil or the like accidentally touches the filter surface, no scratching is caused on the surface.

13 Claims, 2 Drawing Sheets

FILTER FOR CRT SCREEN

FIELD OF THE INVENTION

The present invention relates to the improvement of a filter for a Cathode Ray Tube (CRT) screen by which electromagnetic waves, electrostatic charge, ultraviolet rays, and the like which are generated from a CRT can be shut off without adversely affecting the resolution of the CRT and so that any influence on a human body by the CRT can be most effectively prevented; and, more particularly, to a filter for a CRT screen which is made from a synthetic resin sheet or film in or on which a conductive net is laminated, and which is formed so as to be closely attached to the CRT surface.

BACKGROUND OF THE INVENTION

CRT displays are widely used as display devices for television receivers, video monitors and apparatuses such as word processors, computers, simulators, synchroscopes, instruments for analysis, medical machines, gaming machines, and the like, and among them, in particular, word processors, computers, are machines which are at present found generally in offices.

However, with the spread of apparatuses such as work processors, computers, and the like, the number of operators who closely observe CRT displays for long period of time also continually increases. In advanced nations, the occupational diseases of operators who operate these apparatuses is becoming a considerable social problem.

Fatigue of the optic nerve is a symptom which is common to these occupational diseases. Amongst factors which exert an adverse influences, it is first considered that the light in the room and sunlight reflected by the CRT screen and entering the eyes of the operators cause fatigue of the optic nerve. In addition, although the sequence of cause and effect has not been sufficiently analysed yet by scientific methods, it is also necessary to consider the influences of electromagnetic waves, electrostatic charge, ultraviolet rays, and the like which are generated by the CRT.

To solve the foregoing problems which result from CRT displays, there has been developed a method for reducing the glare of the light by making the screen surface of the CRT rough, a flat filter of a low reflection factor and a filter having a conductive layer, attached to the front of the CRT screen, in order to reduce the glare of the light, and so on.

Techniques to make the surface rough to reduce the glare of the light of the CRT display have been disclosed in, for example, Japanese Patent Laid-open Publications Nos. 55-12107, 56-32653 and 60-125681.

On the other hand, techniques to directly use a net as a filter have been disclosed in, for example, Japanese Utility Model Laid-open Publication No. 60-107802, Japanese Patent Laid-Open Publications Nos. 57-126054 and 61-46903. Further, a detachable filter of the type which is closely adhered onto the surface of the CRT has been set forth in, for example, U.S. Pat. No. 4,253,737 and Japanese Utility Model Laid-open Publication No. 59-106176.

Again, a conductive filter for a CRT screen has been shown in, for example, Japanese Utility Model Laid-open Publication Nos. 59–106176 and 60–125681, and Patent Laid-open Publication No. 61–15480. Such a filter is a one having a thin metal layer which is formed by evaporation or sputtering onto the surface of the filter, or else embodying a net consisting of conductive fiber. Further, there has been proposed a method whereby a transparent resin filter containing lead or the like is attached to the CRT screen, thereby minimizing harmful influences of the electromagnetic waves, static electricity, and the like.

However, the CRTs which are generally used have the curved screens, so that is a flat filter is attached to the screen, the display image at the corners of the screen is distorted and becomes hard to see.

Therefore, the operator who works with a CRT prefers not to attach a filter, with the disadvantage that working with the filter detached frequently occurs. In addition, when a flat filter is attached to the curved screen of a CRT, the electromagnetic waves can leak from the gap between the CRT screen adn the filter, so that the screening effect is reduced.

Since the existing flat filters need special frames adapted to be attached to the CRT, there is the disadvantage of a significant increase in cost.

In the case of the filter comprising a deposited metal layer on the surface, distortion at the corners of the CRT screen is not caused; however, it has the disadvantages that glare-proofing is difficult and fingerprint marking and the like are conspicuous.

On the other hand, in the case of a CRT filter consisting of a net, the glare of the light can be remarkably reduced; however, upon attaching this filter closely to the CRT screen, there rises a problem that moire fringes can be produced between the scanning lines of the CRT and lines of dots of the shadow mask or the wires of a net. In particular, when a filter of the net type is closely attached to a color CRT, even if the meshes or wires of the net are disposed of at an angle to the scanning lines, the moire fringes cannot be prevented by this means.

Further, when a filter having a metal layer deposited by evaporation onto the outer surface, or a filter on which is laminated a net consisting of conductive fiber is attached to the CRT, and if a hand or the like touches the filter surface, the operator often receives an electric shock due to electrostatic charge, and further, in the case of cleaning the surface of such a filter, there are problems in that the metal layer of the surface or the net consisting of conductive fiber may be abraded or peeled off, so that the conductivity and glare-proofing are lost.

SUMMARY OF THE INVENTION

It is an object of the present invention to provide a filter for a CRT screen by which the electromagnetic waves, static electricity, ultraviolet rays, and the like which are generated from a CRT can be substantially shut off without spoiling the resolution and clearness of the CRT display, and an adverse influence on the human body from the CRT can be substantially prevented.

According to the invention, a conductive net is adhered to a single synthetic resin sheet, or is sandwiched between two sheets to thereby form a composite sheet, and a filter which can be closely attached to a CRT screen is formed from this composite sheet.

In the case, the conductive net may be placed inside next to the CRT screen or vice versa, i. e. may be placed on the outer surface of the filter.

As the materials of the synthetic resin sheet which are used in the present invention, for example, transparent resins such as polyvinylchloride, high nitryl resin, polyether-ether-ketone, polyethersulfone, polycarbonate, diethleneglycol-bis-allyl-carbonate resin, polyethylene-terephthalate, polymethyl-methacrylate, acrylonitrilestyrene co-polymer etc., are applicable; in particular, polyvinylchloride is recommended because it is hard to burn. According to the circumstances, an ultraviolet rays absorbent, infrared rays absorbent, antistatic agent, dye, pigment, or the like may also be added to the materials of the synthetic resin sheet.

In an embodiment of the invention, a net consisting of conductive fiber is laminated on the outside or inside surface of a synthetic resin sheet or film. To avoid the occurrence of moire fringes, the mesh of the net is chosen at a suitable value such that the ratio of the pitch of the scanning lines of the CRT and the pitch of the wires of the net does not fall near simple integers, namely, 1, 2, 3, 4, 5 and the inverse numbers thereof.

The net is adhered onto the surface of a single synthetic resin sheet or film, or the net is sandwiched and laminated between two sheets or films, to make a composite sheet. The sheet is molded so to be closely attached to the surface of the CRT screen; also, the sheet is produced to an average surface roughness Ha, at least on the side which does not come into contact with the CRT screen, of 0.2 to 5 microns.

The angle between the "warp" and "woof" of the fiber net can be set to a right angle or an angle other than the right angle. The net may be woven as a plain weave or the like, or the "warp" and "woof" may be merely arranged like a lattice work without weaving, or the net may be woven in some other known fashion, and also the net may lack either the "warp" or "woof". The net is not to be considered as limited to one which consists of fibers, strings, threads, yarns, wires, or the like but an equivalent made by, for example, forming a number of holes or slits in a flat plate or film is also to be regarded as a net.

For the foregoing conductive net, it is possible to use a net consisting of metallic fibers such as gold, silver, copper, aluminum, stainless steel, brass, etc. or a net consisting of carbon fibers. In addition to these, it is also possible to use a metal-coated net, consisting of fibers such as cotton, nylon, silk, carbon fibers, polyester fibers, polyurethane fibers, aramide fibers, polyacetal fibers, acrylic fibers, etc. on the surface of which a metal such as gold, silver, copper, aluminum, stainless steel, brass, nickel, chromium, cobalt, lead, zinc, etc. is coated.

The diameter and density of the fibers of the net may be determined in accordance with the size of CRT with which it is to be used, however, the net should have an aperture ratio of 20% or more.

A filter using a net whose aperture ratio is below 20% is not practical because the light transmittance is low; however, if a net having a low density of fibers is used to improve the light transmittance, the glare-proofing is reduced.

To improve the light transmittance, the capability of transmisson without glare and the avoidance of glare from reflected light, it is preferably to use a net which consists of wires having a diameter within the range of 10 to 100 microns and which is woven such that the fiber density lies within the range of 20 to 120 fibers/cm.

For manufacturing a filter according to the present invention, it is preferable to use a method whereby after a laminate consisting of a net and a transparent synthetic resin sheet or film has been pre-fabricated, it is molded by a vacuum molding process or the like into a shape adapted to be closely attached to the CRT screen.

As a method of adhering the net and transparent synthetic resin material, it is possible to use a thermal pressing method, casting method, thermal laminating method, a method of adhering by use of an adhesive agent, or the like. Among these, the thermal pressing method is preferable.

For molding the filter into a shape adapted to be closely attached to a CRT screen, by a molding process such as a vacuum molding process or the like, it is possible to use a conventional metallic mold made of aluminum or the like, wooden mold, ceramics mold, gypsum mold, epoxy resin mold, etc.. On the other hand, a CRT which is made solid by filling in with gypsum or the like can also be used as a mold.

The sheet thickness of the filter is preferably selected at a value within the range of 0.5 to 5 mm. A filter made as a thin sheet whose thickness is below 0.5 mm cannot be used, since it is not strong enough.

On the other hand, a thick sheet having a thickness above 5 mm is undesirable, because of the risk of ghosting (double images) appearing.

In the assembly of a CRT in which a filter formed as described above is disposed between the CRT and the escutcheon, because it takes a long time to exchange and fit the filter, specially high durability is required of the filter. Therefore, it is recommended to provide a hard coating layer, having a hardness above pencil hardness 4H, on the outer surface of the filter which is opposite to the CRT screen. If the hardness of the hard coating layer is below the pencil hardness 4H, the scratching can easily take place on the outer surface of the filter under the ordinary use conditions of the CRT. In the present invention, the pencil hardness is measured according to the Japanese Industrial Standard K-5400.

As a hard coating material to form the hard coating layer on the filter, it is possible to use thermosetting type resins such as silicone, epoxy, phenol, melamine resin, ultraviolet ray hardening type resin such as acrylic, urethane resin, and the like.

In the filter according to the invention, the glossiness Gs (60°) of the filter surface is preferably selected at a value within a range of 20 to 60% in order to obtain a high degree of glare-proofing.

In the case of a filter having the net exposed on the outside surface, as the glossiness Gs (60°) of the filter surface already lies within the range of 20 to 60% in this state; there is therefore no need to perform a special treatment for glare-proofing.

However, in the case of forming a further hard coating layer on the surface, it is desirable to mix a powder of fine silica or polyethylene into the hard coating layer in order to further improve the glare-proofing.

The average diameter of the particles of the powder of the fine silica or polyethylene which are mixed into the hard coating layer is selected at a value within the range of 1 of 50 microns, preferably, 3 to 20 microns. In the case of a powder whose average diameter is smaller than 1 micron glare-proofing is insufficient, but a large grain powder of more than 50 microns may produce moire fringes.

The mixture ratio of the powder of silica or polyethylene to the hard coating material is selected within the range of 3 to 30 weight %, preferably, 5 to 20 weight %. When this mixture ratio is smaller than 3 weight %, sufficient glare-proofing cannot be obtained, but a high mixture ratio more than 30 weight % lowers not only the hardness of the filter surface but also the light transmittance and reflection factor beyond the lowest limit needed, so that when such a filter is attached to the CRT, the resolution and brightness deteriorate remarkably.

The thickness of the hard coat containing the powder of silica or polyethylene cannot be closely specified because it differs in dependence on the average diameter and mixture ratio of the contained powder; however, in general, it is preferably selected at a value of 3 to 20 microns. With a thickness thinner than 3 microns, the surface hardness of the coating layer is low, while when the thickness is greater than 20 microns, the light transmittance of the filter is remarkably reduced.

In addition to the powder of silica or polyethylene, a diluent, dispersing agent, sensitizer, antistatic agent, dye, pigment, metal powder, etc. can be added as necessary to the hard coating which is applied to the surface of the CRT filter.

On the other hand, in order to avoid scratching and dust, one or both of the surface of the filter may also be covered by a protective film which can easily be peeled off. In this case, after the net and the synthetic resin sheet or film are adhered to one another, one or both of the surfaces are covered by the easily peeling protective film and the composite sheet can then be formed into a shape adapted to be closely attached to the CRT.

In the case of the filter according to the invention, by connecting the conductive net to an earth terminal and grounding, the electromagnetic wave shielding performance and electrostatic charge dissipating performance are further improved as compared with conventional filters.

The method of grounding the net by connecting it to an earth terminal is not particularly critical; however, by way of example, the following methods can be used: a method whereby when the metallized net is laminated, a part of the net is exposed to the outside of the sheet and the exposed portion is used as a grounding terminal: a method whereby a conductive paint is applied to the peripheral portion of the filter so as to come into contact with the net and this painted portion is used as the earth terminal: a method whereby a hole is formed at a location on the filter surface that is not closely attached to the CRT, the inner surface of the hole is treated using a conductive material so as connect with the net, and this hole is used as the earth terminal: a method whereby a small portion of the filter is dissolved and removed using an appropriate solvent and the exposed net is used as the earth terminal; and so forth.

In the case of the filter formed such that the conductive fiber is exposed at the surface, an end portion of the fiber can be clamped by a metallic fastener which is grounded using a conductive tape, lead wire, or the like.

For attaching the filter to the CRT screen, the following methods can be used; a method whereby the sheet is cut to a size which is slightly smaller than the inside of the escutcheon and is attached to the CRT screen using an adhesive, a pressure sensitive adhesive, pressure sensitive adhesive tape, or the like, before or after the escutcheon is in place: and a method whereby the filter is inserted between the escutcheon and the CRT.

In the case of inserting the filter between the escutcheon and the CRT, the sheet can be cut to a size such that the peripheral portion of the filter is covered by the escutcheon of the CRT and the filter is fixed by use of screws, adhesive, pressure sensitive adhesive, adhesive tape, or the like, to a fastening band that secures the CRT.

If the filter is not to be removed again after attachment to the CRT screen, it is recommended to fill and close the gap between the peripheral portion of the filter and the CRT screen with a filler material, adhesive tape, or the like in order to prevent dust, vapour and the like from entering the gap between the filter and the CRT screen.

DETAILED DESCRIPTION OF THE PREFERRED EMBODIMENTS

Figure 1:
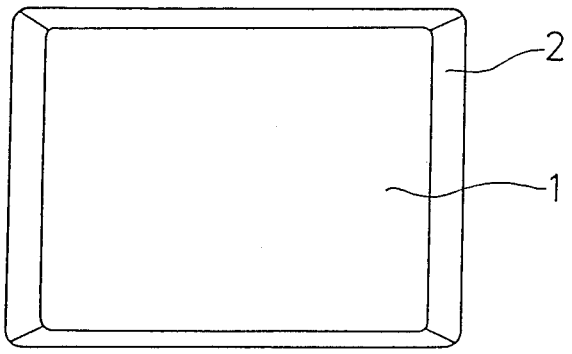
FIG. 1 is an explanatory diagram showing one embodiment of a filter for a CRT screen according to the present invention.
Figure 2:
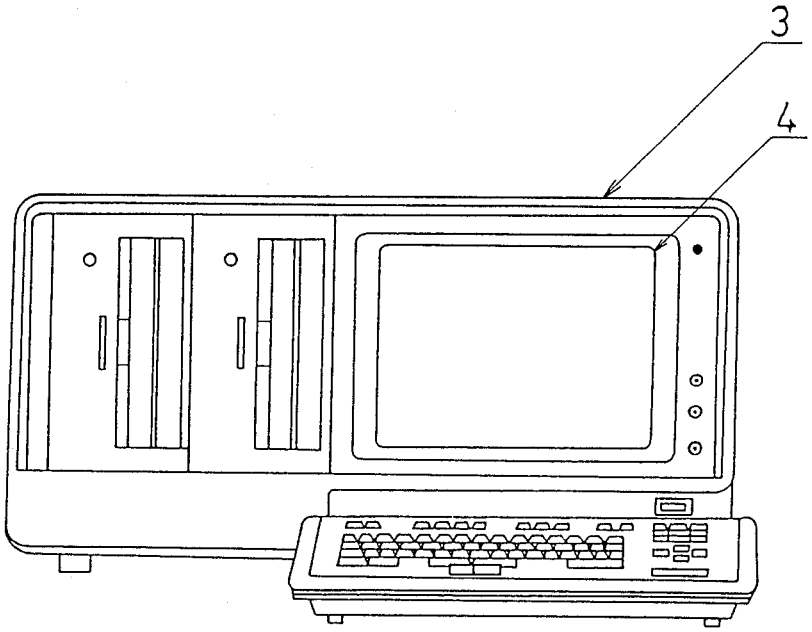
FIG. 2 is an explanatory diagram showing an apparatus using the CRT screen filter.

Referring to FIGS. 1 to 4, reference numeral 1 denotes a filter; 2 is a bezel portion of the filter 1; 3 is an apparatus using the filter according to the invention; 4 is a CRT screen of the apparatus 3; 5, 6, and 7 are filters; *5a*, *5b*, *6a*, *6b*, *7a*, and *7b* are earth connecting terminals which have been conduction-treated; 8 is a CRT; 9 is a filter; and *9a* is a lead wire for earthing.

EXAMPLE 1

The filter for a CRT screen according to the invention shown in FIGS. 1 to 4 was formed in the following matter.

A conductive net made of polyethylene-terephthalate fibers with a fiber diameter of 20 microns and a mesh of 80 fibers/cm and sputtered with metallic copper was sandwiched between two high nitril sheets "ZEXLON" (Trademark of Mitsui Toatsu Chemicals, Inc.) each having a thickness of 0.5 mm and the assembly was hot-pressed. Thus, a laminated sheet having a thickness of 1.2 mm was obtained.

The laminated sheet was shaped using a mold made of aluminum by a vacuum molding process in order to form the filter, one surface which was then closely attached to the screen of the CRT 8.

With the CRT filter made in this manner, scratches or like markings were not caused on the surface when molding the filter. Even when the filter was attached to a CRT screen of a size of 14 inches, no moire fringes were produced.

EXAMPLE 2

A polyvinyl-chloride sheet having a thickness of 1 mm was adhered to a conductive polyethylene-terephthalate net with a fiber diameter of 40 microns, and a mesh of 54 fibers/cm, and onto which metallic copper has been sputtered. Thus, a laminate sheet was obtained.

This laminated sheet was formed by use of a mold as in Example 1, so that the filter 1 was obtained, with a shape adapted to be closely attached to a CRT screen, the net of the laminate being on the opposite surface of the filter to the CRT screen.

The average surface roughness Ha of the outer surface of the filter was measured by a measuring instrument on the basis of the JIS B-0651 (cut-off wave length; 0.25 mm, measuring length: 2 mm). The measured value of Ha was 0.28 microns.

The glossiness Gs (60°) was measured and a value of Gs of 30% was obtained.

The CRT filter 1 formed in this manner was attached to a CRT screen with a size of 14 inches. However, no moire fringes were produced. An end portion of the filter was flamed and the degree of flammability was observed by eye. It was thus confirmed that the filter does not burn.

EXAMPLE 3

A polyvinyl-chloride film on which "STRACT BOND" (Trademark of Mitsui Toatsu Chemicals, Inc.) had been applied as a pressure sensitive adhesive was adhered to one surface of the laminate sheet of Example 2. A filter of a shape adapted to be closely attached to the screen surface of a CRT was formed with this laminate sheet in a manner similar to the case of Example 2.

EXAMPLE 4

Figure 3A:
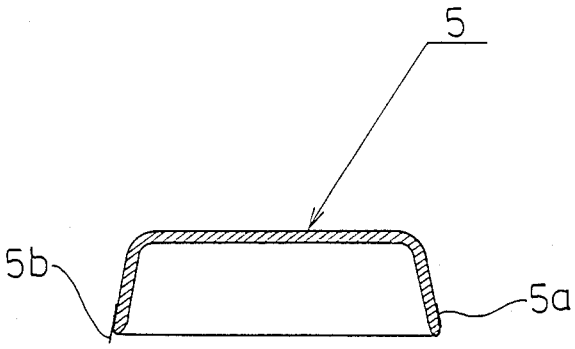
FIG. 3 is cross sectional views showing other embodiments of filter for a CRT screen according to the invention.
Figure 3B:
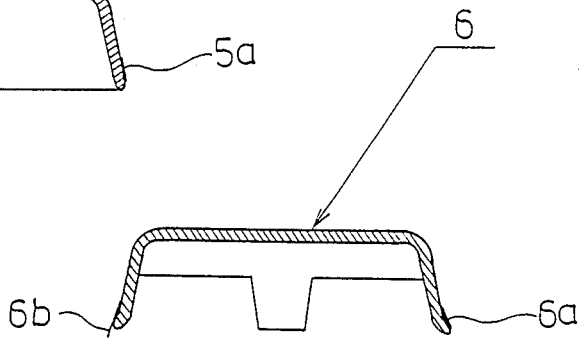
Figure 3C:
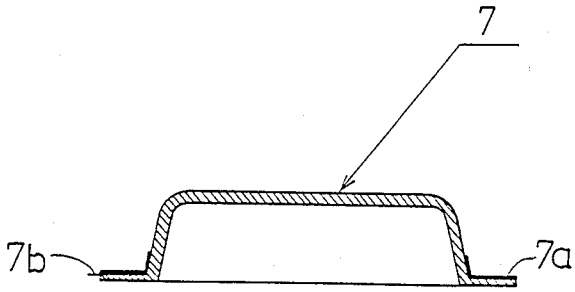
Figure 4:
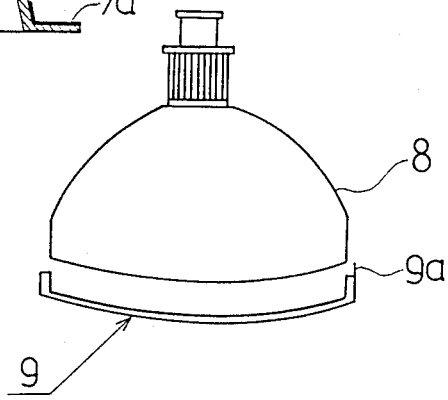
FIG. 4 is an explanatory diagram showing attachment of the filter according to the invention to a CRT.

Inserting the filter of Example 2 between a CRT screen and the escutcheon, and adhering "SCOTCH CONDUCTIVE TAPE 1245" (Trademark of Sumitomo 3M, Co., Ltd.) to the periphery of the filter, earth connecting portions *5a, 5b, 6a, 6b, 7a,* and *7b* were provided on the filters 5, 6, and 7 respectively, as shown in FIG. 3.

The filter was attached to the CRT 8 and the earth-connecting portions were grounded. Then, this filter was used for ten minutes at a temperature of 20° C. and a humidity of 60%. Thereafter, the electrostatic charge was checked by an electroscope; however, no charge was found on the filter.

EXAMPLE 5

A surface hardening agent of the ultraviolet rays hardening type "ORESTAR XRA-1458" (Trademark of Mitsui Toatsu Chemicals, Inc.; content of solid matter 80 weight %) was applied to the surface of the filter of Example 1 opposite to the CRT screen.

Then, this filter was dried for 15 minutes at 50° C. Thereafter, the surface was hardened by irradiating with the ultraviolet rays of a high pressure mercury lamp of 80 W/cm for 15 seconds. Further, a conductive paint was applied to the peripheral portion of the filter and a grounding guide was attached. The filter was grounded and attached to the CRT in a manner similar to that of Example 4.

The measured value of the surface hardness was 4H on the pencil hardness scale of JIS K-5400.

The outer surface of the filter was rubbed with a steel wool (#000) made of stainless steel. However, no scratching was caused.

Further, the electrostatic charge was checked by a method similar to that in Example 4. However, no charge was found on the filter.

EXAMPLE 6

A mixture consisting of 53.5 weight % of a hard coating agent of the ultraviolet rays hardening type "ORESTAR XRA-1458" (Trademark, of Mitsui Toatsu Chemicals, Inc.; content of solid matter 80 weight %) 10.9 weight % of silica powder having an average grain diameter of 5 microns, and 35.6 weight % of ethyl-acetate as a diluent, was applied to the surface of the filter of Example 2 opposite to the CRT screen. Then, this filter was dried for five minutes at 50° C. Thereafter, the light of a high pressure mercury lamp of 80 W/cm was irradiated onto the filter at a distance of 15 cm for 30 seconds. In this way, a hard coating layer of a thickness of 8 microns was formed.

The glossiness Gs (60°) and the average surface roughness Ha were measured by the methods similar to that in Example 2.

Thus, the value of Gs of 40% and Ha of 0.8 microns were obtained. The surface hardness of the hard coating layer was 4H on the pencil hardness scale. Further, the difficulty of scratching the surface was examined by a method similar to that in Example 5. No scratching was caused on the surface of the filter.

The filter was attached to a CRT screen of a size of 14 inches and the clearness of characters displayed on the screen was observed by eye, and it was thus confirmed that the images were very clear.

EXAMPLE 7

A hard coating layer was formed in a manner similar to that in Example 6, except that polyethylene particles of an average diameter of 5 microns were used in place of the silica powder. This hard coating layer was applied to the surface of the filter of Example 2 opposite to the CRT screen shown.

The glossiness Gs (60°) and the average surface roughness Ha were measured by the methods similar to that in Example 2, and the values of Gs or 45% and Ha of 0.5 microns were obtained.

The surface hardness was 4H on the pencil hardness scale. Resistance of the surface to scratching was measured by a method similar to that in Example 5, thus, no scratching was caused on the surface of the filter.

The filter was attached to a CRT screen of a size of 14 inches and the clearness of characters displayed on the screen was observed by eye, however, no problem was encountered.

COMPARISON EXAMPLE 1

The original sheet obtained in Example 1 was cut into a size adapted to cover a CRT screen and the resultant flat-shaped sheet was used as a filter.

The glossiness Gs (60°) and the average surface roughness Ha were measured by the methods similar to those in Example 2, the values of Gs of 95% and Ha of 0.01 microns were obtained.

The surface hardness was 3 H on the pencil hardness scale. However, upon examination of resistance to scratching of the surface by a method similar to that in Example 5, it was found that many scratches were produced on the surface of the filter of the CRT.

Further, the filter was attached to a CRT of a size of 14 inches and the clearness of characters displayed on the screen was observed by eye. The light reflection from the filter surface was strong and it was difficult to read the characters displayed on the CRT.

COMPARISON EXAMPLE 2

The original sheet obtain in Example 2 was cut out into a size adapted to cover a CRT screen and the resultant flat-shaped sheet was used as a filter in a manner such that the surface having the net was located on the opposite side to the CRT screen.

The glossiness Gs (60°) and the average surface roughness Ha were measured by the methods similar to those in Example 2, the value of Gs was 30% and the value of Ha was 0.28 microns, and also, the surface hardness was 2 H on the pencil hardness scale. Resistance to scratching of the surface was examined by a method similar to Example 5, and it was found that many scratches were caused on the filter surface.

Further, this filter was attached to a CRT and the clearness of the characters displayed on the screen was observed by eye. In this case, it was found that the light reflection from the filter surface was not so strong; however, since the filter was not closely attached to the CRT, the video image on the CRT could not be clearly recognized.

What is claimed is:

1. A filter for a CRT screen constructed from a sheet having a conductive net, and formed so as to be closely attached to a CRT screen surface;

wherein to avoid the occurrence of moire fringes, the mesh of the net is selected at a suitable value such that the ratio of the pitch of the scanning lines of the CRT and the pitch of the wires of the net does not fall near simple integers or the inverse numbers thereof.

2. A filter according to claim 1, wherein said conductive net consists of a synthetic resin fiber with the surface covered with a metal.

3. A filter according to claim 1, wherein said filter is formed integrally with an escutcheon.

4. A filter according to claim 1, wherein said conductive net is exposed to either one of the surfaces of said filter, and an average surface roughness Ha of the surface of the filter on the side at which the conductive net is exposed is selected at a value within the range of 0.2 to 5 microns.

5. A filter according to claim 1, wherein the glossiness Gs (60°) of the surface of the filter on the side opposite to the CRT screen is selected at a value within the range of 20 to 60%.

6. A filter according to claim 1, wherein a hard coating layer is formed on the surface of said filter on the side opposite to the CRT screen.

7. A filter according to claim 6, wherein the hardness of the hard layer is 4 H or more on the pencil hardness scale.

8. A filter according to claim 6, wherein the hard layer contains 3 to 30 weight % of silica powder whose average particle diameter falls within the range of 1 to 50 microns.

9. A filter according to claim 6, wherein the hard layer contains 3 to 30 weight % of polyethylene powder whose average particle diameter lies within the range of 1 to 50 microns.

10. A filter according to claim 1, wherein a synthetic resin sheet or film used for the filter is made of polyvinyl-chloride.

11. A filter according to claim 1, wherein a grounding terminal is connected to the conductive net.

12. A filter according to claim 11, wherein a hole is formed at an arbitrary position in said filter on the side opposite to the CRT screen, and an earth connection is led out from said hole.

13. A filter according to claim 1, wherein at least one of the surfaces of said filter is covered by a protective film which can be peeled off.

* * * * *